US006299110B1

(12) United States Patent
Ferraiolo

(10) Patent No.: US 6,299,110 B1
(45) Date of Patent: Oct. 9, 2001

(54) PROTECTIVE NETTING COMPRISING CONNECTED CROSSED CABLES, FOR EXAMPLE, SNOW OR GROUND NETTING

(75) Inventor: Francesco Ferraiolo, Ca' de' Fabbri (IT)

(73) Assignee: Officine Maccaferri SpA, Bologna (IT)

( * ) Notice: Subject to any disclaimer, the term of this patent is extended or adjusted under 35 U.S.C. 154(b) by 0 days.

(21) Appl. No.: 09/260,536

(22) Filed: Mar. 2, 1999

(30) Foreign Application Priority Data

Mar. 2, 1998 (EP) ..... 98830109

(51) Int. Cl.[7] ..... B21F 27/08; E01F 7/04

(52) U.S. Cl. ..... 245/3; 52/712; 52/665; 403/400; 256/47; 140/93 A

(58) Field of Search ..... 403/400, 346; 256/47, 48; 52/712, 719, 665; 140/11, 12, 93 A; 245/3

(56) References Cited

U.S. PATENT DOCUMENTS 436,950 * 9/1890 Tarkington .
496,087 * 4/1893 Lamb .
556,832 * 3/1896 Mount .
557,490 * 3/1896 Combs .
706,948 * 8/1902 Imbler .
707,743 * 8/1902 Wellman .
822,292 * 6/1906 Mills .
841,194 * 1/1907 Swank .
906,460 * 12/1908 Pringle .

FOREIGN PATENT DOCUMENTS 0 428 848 5/1991 (EP) .
0 589 080 3/1994 (EP) .
594 316 9/1925 (FR) .

* cited by examiner

*Primary Examiner*—Robert Canfield
(74) *Attorney, Agent, or Firm*—Sughrue, Mion, Zinn, Macpeak & Seas, PLLC

(57) ABSTRACT

Protective netting comprises cables (11, 12) crossing in pairs and defining intersection points (10) at which the pairs of cables (11, 12) are fixed together by a connection (13, 14, 15, 16) comprising two first wires (13, 15) each of which has windings around a respective cable (11, 12) on either side of an intersection point and extends across the other cable (12, 11) in order to restrain it at the intersection point. The connection further comprises at least two further wires (14, 16) wound around respective cables and inserted between the windings of the two first wires (13, 15) so as to form groups of turns disposed in the vicinity of each intersection point.

3 Claims, 2 Drawing Sheets

PROTECTIVE NETTING COMPRISING CONNECTED CROSSED CABLES, FOR EXAMPLE, SNOW OR GROUND NETTING

BACKGROUND OF THE INVENTION

The present invention relates to the field of protective netting, for example, snow or ground netting. Purely by way of example, netting of this type may be used either alone as close-fitting netting laid on and fixed to the ground, or as part of protective barriers.

In mountainous regions, protective barriers are used widely to shelter and protect installations or infrastructures from possible landslides, falling rocks, or avalanches. These protective barriers are generally constituted by metal netting structures which are sufficiently flexible to absorb the energy of bodies such as stones, earth, avalanches or the like, which strike them and bear on them. The netting, which is supported by posts firmly fixed in the ground or to the rock, is generally formed by steel wires or cables crossed, preferably at right angles. At the intersection points the cables are clamped together by connection devices of various types, the most common of which comprise a pair of opposed, shaped plates between which the cables are clamped.

Connection devices of the known type indicated above have the disadvantage that they substantially increase the cost of the metal netting and hence of the barrier structure both because of the intrinsic cost of the materials and of the process for the manufacture of the plates, and because, in most cases, the cables have to be clamped manually at the intersection points. Since the protective barriers may be used to protect such large geographical areas that the barrier netting often has to cover considerable distances, it can be understood that the problem of reducing the cost of the netting is of primary importance in the field.

European patent 0428848 describes a system for producing barrier netting constituted by crossed metal cables. At each intersection, two cables are bound in the form of a cross by two wires each having its ends wound on a respective cable on opposite sides of the intersection point. This system is simple and inexpensive and can also be at least partially automated.

However, tests carried out by the Applicant have shown that the known system of the type indicated above is effective only when small loads are expected on the barrier netting. In fact, a joint between two crossed cables formed in accordance with the teachings of the above-mentioned patent was subjected to tensile tests in a direction perpendicular to the plane of the netting and to slip tests performed by exerting a pull on one of the two crossed cables in the plane of the netting. The results of the tests showed, first of all, a fairly high variability of the strength of the joint, probably because of difficulty in achieving uniform and balanced tightening of the windings of the wires on the cables. As a consequence of the wide variability of the results, it is impossible to guarantee that the strength of the protective netting as a whole, which comprises a very large number of such connections, will be greater than the lowest of the values obtained experimentally.

A second not very encouraging experimental result which emerged from the tests carried out consisted of the poor strength of the joint formed by the two wires which—although comparable with the average of the other known systems—is very far from the strength of the best (and most expensive) systems comprising clamping plates. The breakage of the joint brought about experimentally always took place by yielding of the wires, above all after a loosening of the joint had been noticed with consequent separation of the cables at the intersection. The use of larger-diameter wires did not solve the problem since the greater curvature to which the wires had to be subjected during the winding around the cables made it difficult to achieve optimal tightening and also caused work-hardening of the metal so that it became excessively brittle.

SUMMARY OF THE INVENTION

The object of the present invention is to overcome the problems of the prior art and to provide protective netting which is simple, inexpensive and very strong. A further object of the invention is to provide a system for joining crossed cables which is reliable over time and which shows strength values within a limited range of variability.

In order to achieve the objects indicated above, the subject of the invention is protective netting comprising cables crossing in pairs and defining intersection points, and further comprising connection means for fixing the pairs of cables together at the intersection points, the connection means comprising two first wires, each of which has windings around a respective cable on either side of an intersection point and extends across the other cable in order to restrain it at the intersection point, characterized in that the connection means comprise at least a further two wires which have windings around respective cables, these windings being inserted between the windings of the first two wires to form groups of turns disposed in the vicinity of the intersection point.

In short, at least four wires are provided, coupled in pairs, in the region of each intersection of the cables, each pair of wires being wound on one of the two cables, on opposite sides of the intersection point and extending across the other cable in order to clamp it.

A further subject of the invention is a protective barrier comprising a plurality of posts supporting a protective netting structure of the type indicated above. The invention also relates to a method of producing protective netting as defined above.

The connection system of the present invention has achieved truly surprising results. In comparison with the known solution which comprises only two wires, the overall strength of the joint is considerably increased to an extent such that, in tensile tests carried out on the joint of the present invention, the breaking load of the steel cables was reached before the binding wires showed signs of yielding. Moreover, the use of two pairs of wires allowed their diameter to be reduced which simplified binding operations and considerably reduced the work-hardening of the metal which was bent to form the windings.

The range of variability of the strength of the joint was found to be very limited, thus providing good repeatability of the joint-strength results achieved by the system of the present invention. Without wishing thereby to provide a complete explanation of the phenomena encountered, it is considered that the surprisingly better results of the present invention can be attributed to an effect which could not be predicted by an analysis of the solutions of the prior art, that is, to the additional friction which is created between the windings of the pair of coupled wires which are tightened against one another at the moment when the joint is subjected to a load. This mutual friction is added to the predictable friction of the wires on the steel cable to improve the overall endurance of the joint which is indicated in the experimental results as well as by the low variability of the strength values and also by reduced separation of the two cables in tensile tests.

The substantial increase in the resistance of the joint to slipping in the plane of the netting is also of particular interest and is also probably due to the effect of the tightening of the turns of the pair of wires against one another under load.

BRIEF DESCRIPTION OF THE DRAWINGS

Further characteristics and advantages will become clear from the following detailed description of a preferred embodiment, given purely by way of non-limiting example, with reference to the appended drawings, in which.

DETAILED DESCRIPTION OF THE DRAWINGS

Figure 1:
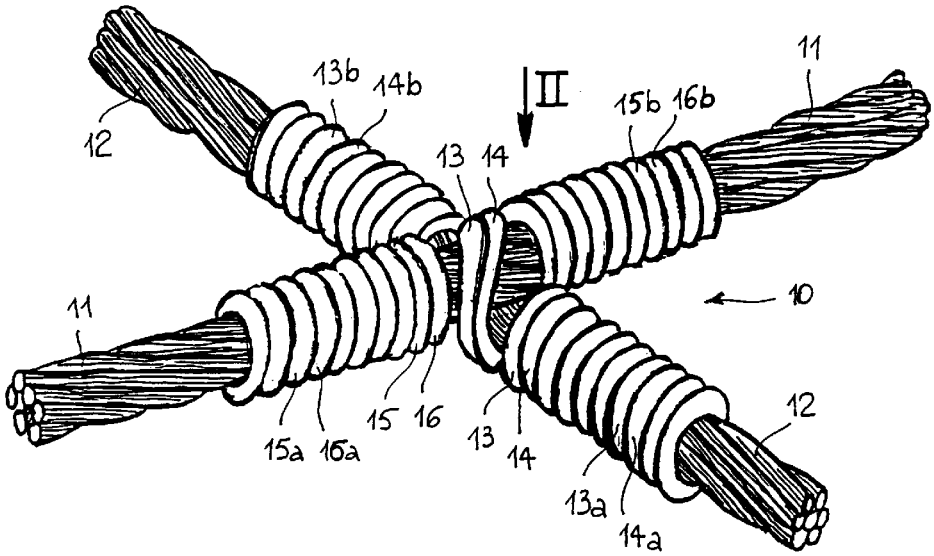
FIG. 1 is a perspective view of a joint of two crossed metal cables, formed in accordance with the principle of the present invention.
Figure 2:
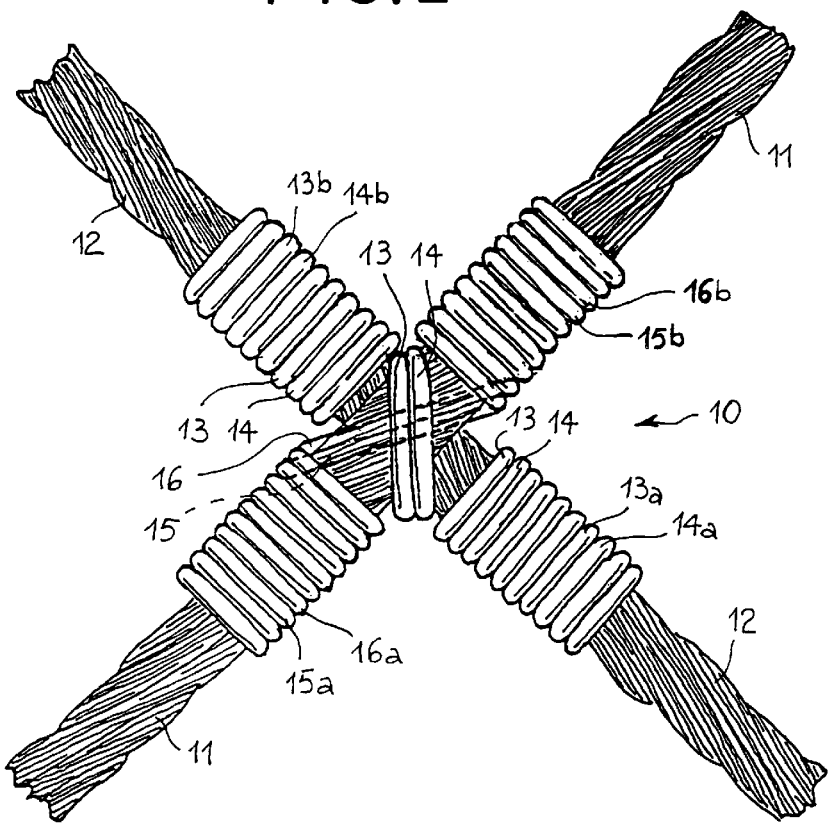
FIG. 2 is a plan view of the joint taken on the arrow II of FIG. 1.

With reference now to FIGS. 1 and 2, protective netting - usable alone as close-fitting netting or forming part of a barrier structure assembly—comprises crossed wires or cables, preferably but not necessarily made of steel. In a generic intersection region 10, a first cable 11 crosses and bears on a second cable 12. A pair of coupled wires 13, 14, preferably metal wires, is tightened transversely over the first cable 11, the ends 13*a*, 13*b*, 14*a*, 14*b* of the wires being wound repeatedly around the second cable 12 to form a group of turns on either side of the first cable 11.

Correspondingly, a second pair of coupled wires 15, 16 is tightened transversely beneath the second cable 12, the ends 15*a*, 15*b*, 16*a*, 16*b* of the wires being wound repeatedly around the first cable 11 to form a group of turns on either side of the second cable 12.

Figure 3:
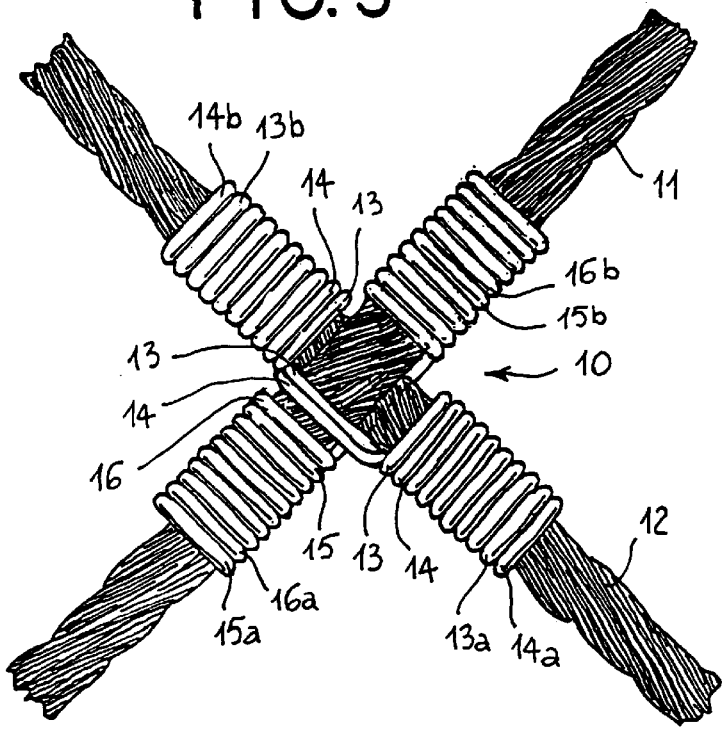
FIG. 3 is a plan view similar to FIG. 2 of a first variant of the joint.

Preferably, the first pair of wires 13, 14 extends obliquely over the first cable 11 and, similarly, the second pair of wires 15, 16 extends obliquely under the second cable, as shown in the drawings, so that the two pairs of wires are arranged relative to one another in the form of a cross. FIG. 3 shows an alternative embodiment in which the wires 13, 14, 15, 16 extend transversely relative to the cables 11, 12.

An embodiment of the joint shown in the drawings, on which tests were carried out but which should not thereby be understood as limiting of the application of the present invention, comprises steel cables with a diameter of 8 mm bound by two pairs of galvanized steel wires of equal diameter, preferably of between 2 and 3 mm. Each end 13*a*, 13*b*, 14*a*, 14*b*, 15*a*, 15*b*, 16*a*, 16*b* of the wires is wound in five turns around the respective portion of cable 11, 12. Altogether, ten turns of wire are therefore arranged side by side on each of the four portions of the cables 11, 12 disposed on opposite sides of the junction.

Figure 4:
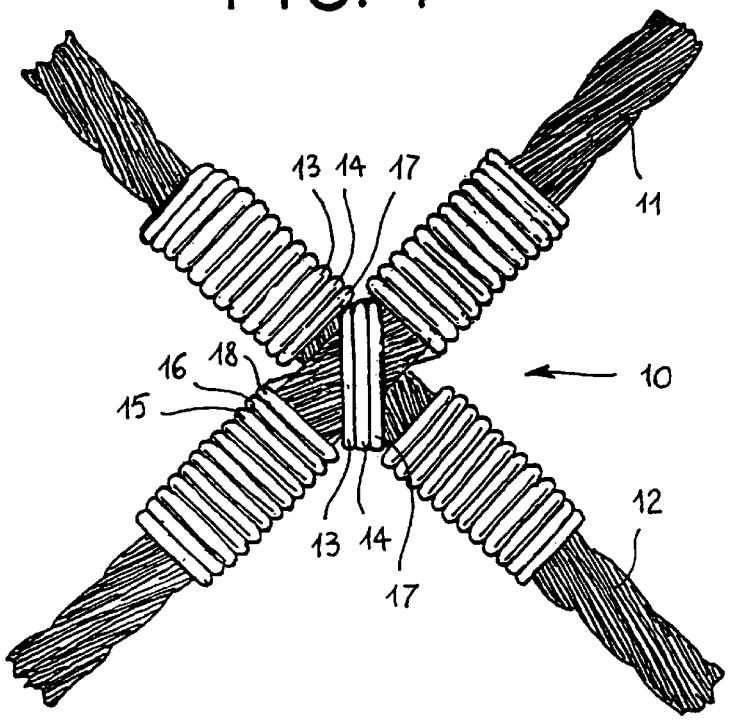
FIG. 4 is a plan view of another variant of the joint.

Naturally, many variations, all falling within the scope of the present invention, may be applied to the embodiment described above. For example, as shown in FIG. 4, the clamping of the cables 11, 12 at the intersection point 10 is achieved by means of six wires 13, 14, 15, 16, 17, 18 grouped in threes. In the particular embodiment shown in the drawing, each wire is wound in four turns on each cable portion 11, 12. In this embodiment, the greater practical difficulties in the formation of the windings of the wires on the cables caused by the need constantly to keep the three wires parallel to one another during winding are offset by the fact that wires of smaller diameter can be used.

The wires 13, 14, 15, 16 may be wound on the cables 11, 12 by hand or, preferably, automatically or semi-automatically by means of pincers or machines specifically arranged for this operation. During the production of protective netting, two rows of steel cables are provided, crossed, preferably at right angles. Cables of the same row are parallel and spaced apart and are bound to the cables of the other row at the intersection points in accordance with the principle of the invention. It is thus possible to produce a flexible netting structure with generally quadrilateral and preferably rhombic or square meshes having an optimal ability to absorb the energy of bodies, for example, such as stones, earth, avalanches, or the like, which might strike it and bear on it. The energy absorbed by the flexible netting is discharged to the support posts which are firmly fixed in the ground or to the rock in accordance with techniques known in the field of the formation of safety barriers.

Naturally, the principle of the invention remaining the same, the forms of embodiment and details of construction may be varied widely with respect to those described and illustrated, without thereby departing from the scope of the present invention.

What is claimed is:

1. Protective netting comprising cables crossing in pairs and defining intersection points, and further comprising connection means for fixing the pairs of cables together at the intersection points, the connection means comprising two first independent wires wound side-by-side around a first cable on either side of an intersection point and extending across a second cable in order to restrain it at the intersection point and two second independent wires wound side-by-side around the second cable on either side of the intersection point and extending across the first cable.

2. Protective netting according to claim 1, characterized in that the wires have uniform, round cross-sections of equal diameter.

3. A method of producing protective netting, characterized in that it comprises the following steps:

providing a plurality of cables in a crossed arrangement such that the cables cross in pairs defining intersection points, providing connection means comprising wires for fixing the pairs of cables together at the intersection points, winding two or more independent side-by-side wires around each cable on either side of an intersection point with central portions of the two or more wires extending across the other cable in order to restrain it at the intersection point, the two or more wires on each cable constantly being kept side-by-side during the winding on the cables.

* * * * *